US005609506A

United States Patent [19]

Williams, Jr.

[11] Patent Number: 5,609,506

[45] Date of Patent: Mar. 11, 1997

[54] OUTBOARD BOAT MOTOR TRANSPORT STABILIZER

[76] Inventor: Thomas M. Williams, Jr., 2310 Old Oxford Hwy., Durham, N.C. 27704

[21] Appl. No.: 582,935

[22] Filed: Jan. 4, 1996

[51] Int. Cl.[6] ..... B63H 5/12

[52] U.S. Cl. ..... 440/53; 440/900; 114/172

[58] Field of Search ..... 114/144 R, 170, 114/171, 172; 440/53, 55, 61–63, 900, 113; 74/475, 480 B, 494, 495; 92/15, 23

[56] References Cited

U.S. PATENT DOCUMENTS

| | | | |
|---|---|---|---|
| 3,517,634 | 6/1970 | Irgens | 114/172 |
| 3,584,595 | 6/1971 | Perry, Jr. | 114/172 |
| 4,054,102 | 10/1977 | Borst et al. | 440/62 |
| 4,521,201 | 6/1985 | Watanabe | 440/63 |

*Primary Examiner*—Edwin L. Swinehart
*Attorney, Agent, or Firm*—Olive & Olive, P.A.

[57] ABSTRACT

The invention provides a device for stabilizing an outboard motor during transport in two embodiments. A first preferred embodiment includes a rigid block which is pivotally mounted from a bracket so as to be adjacent to a yoke which connects between the push rod end of a steering cable and a link to the outboard motor. The block has a hole in a position to enable engagement of an extended bolt on the yoke and can be pivoted to cause such engagement. In the engaged position, a wing nut is tightened to hold the block in position over the bolt, thus preventing movement of the outboard motor.

In the second embodiment, a split block is provided of a material possessing a highly frictional surface. The split block has a hole with a split to an outer surface and is permanently mounted with a push rod of the steering cable extending through the hole. To secure the outboard motor against movement during transport, the split is clamped tightly with a transverse bolt to bring pressure from the inner surface of the hole on the push rod.

3 Claims, 3 Drawing Sheets

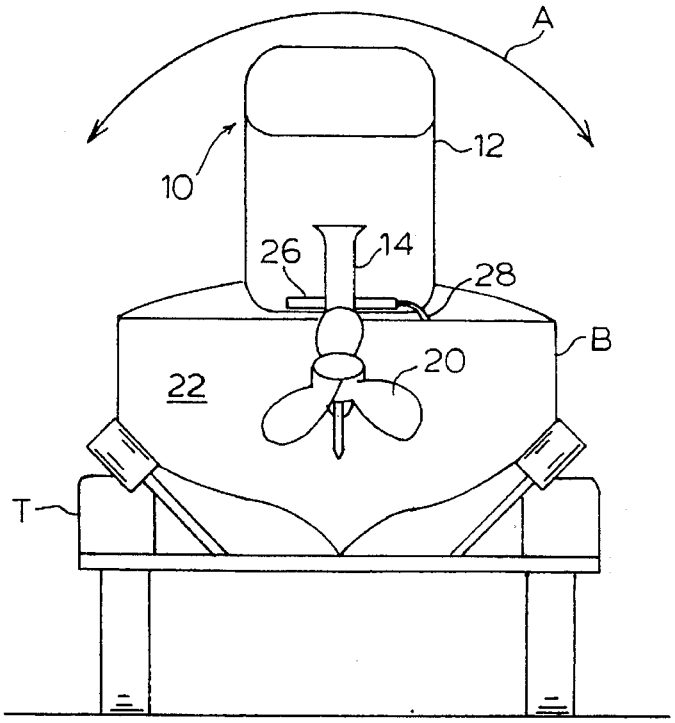
FIG. 2
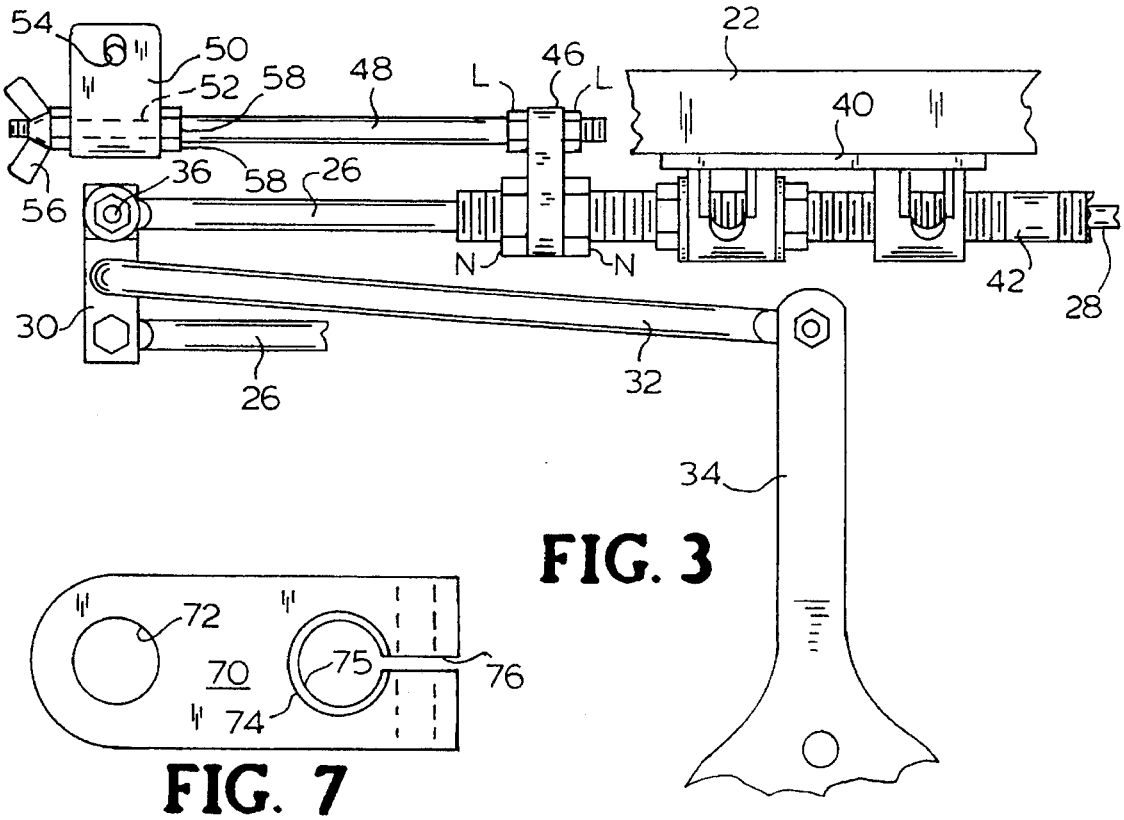
FIG. 3
FIG. 7

OUTBOARD BOAT MOTOR TRANSPORT STABILIZER

BACKGROUND OF THE INVENTION

1. Field of the Invention

This invention relates to outboard boat motors, and more particularly to apparatus for stabilizing an outboard motor mounted on a boat which is being transported.

2. Description of the Problem Addressed

An outboard motor is almost universally adapted to being mounted to the transom of a boat such that the portion of the motor comprising a gasoline engine and its housing resides above the top of the transom and the propeller resides below the water line of the boat. As used herein, and as understood in the trade, the term "outboard motor" refers to an assembly of a gasoline fuel operated internal combustion engine enclosed within a housing from which a drive shaft extends generally downwardly to connect to a lower gear set providing drive power to a propeller. Directional control of the boat is accomplished by pivoting the outboard motor on its mount (by means of connected steering cables for all but the smallest motors), which directs the propeller in the desired direction. The typical steering mechanism has some components which are fixed to the boat and others which are moveable in order to angularly position the motor relative to the boat.

It is common to transport a boat to and from a body of water on an individual trailer with the motor attached to the boat's transom. In the process of pulling the boat out of the water and of placing the boat in the water with the trailer, the boat will generally be moved through very shallow water. So as to prevent damage to the propeller and the lower gear housing, the outboard motor is tilted to position the drive shaft at an angle in the range of 45° to the vertical. This position of the outboard motor is maintained when the boat is mounted on the trailer and transported over the road.

An outboard motor is typically built with the majority of the bulk of its gasoline engine disposed rearward of its drive shaft, so that little space within the body of the boat is taken by the outboard motor. When the outboard motor is in the tilted position on a trailer as described above and is being transported, the majority of the weight of the gasoline engine is above the drive shaft. When the trailer is pulled around a turn at highway speeds, considerable force of inertia is exerted which causes the weight of the gasoline engine to tend to shift around its pivot point toward the outside of the turn. This shift of motor weight, which may be as much as 500 pounds in a large outboard motor, can cause damage to the boat's transom and even cause the trailer to sway. Outboard motor makers typically suggest that the boat owner secure the motor against such a shift by tying the motor in a sidewards position with a rope or an elastic strap. Such a safety measure may not be reliable, and may not always be employed, partly because it is troublesome and partly because a tie cord or strap of suitable size and strength may not be accessible when needed.

It is therefore an object of this invention to provide an apparatus for reliably securing an outboard motor against shifting during transport.

It is a further object of this invention to provide an apparatus for securing an outboard motor against shifting during transport and which is simple and quick to engage and disengage.

It is an additional object of this invention to provide an apparatus for securing an outboard motor against shifting during transport and which is designed so that it may be stored at or near its place of use for accessibility.

Other objects and advantages will be more fully apparent from the following disclosure and appended claims.

SUMMARY OF THE INVENTION

The invention provides a clamping mechanism which is permanently mounted in the vicinity of the pivotal mount of the outboard motor for easy access and use. In a first embodiment, an auxiliary member having a transverse hole adapted to engage an extending pin is pivotably mounted on a fixed brace. The brace mounts on a relatively fixed portion of the steering mechanism. The pin is connected to a moveable component of the steering device. In order to use the clamping mechanism, the steering mechanism is positioned so that the pin is aligned with the hole in the auxiliary member. The auxiliary member is pivoted so that the hole engages the pin and the member is then locked in position, which locks the moveable component on which the pin is mounted. The outboard motor is thus prevented from movement. During use of the motor on the water, the member is locked into a non-engaging position to permit movement of the steering mechanism.

A second embodiment of the invention comprises a member having a hole which is permanently mounted in circumferential proximity to a boat's steering cable and fixedly connected to another component which is always a known distance from the steering cable. The member is preferably formed of a material capable of frictionally gripping the steering cable, and is forced into engagement to lock the position of the outboard motor.

BRIEF DESCRIPTION OF THE DRAWINGS

FIG. 2 is a rear elevation view of the boat and outboard motor of FIG. 1.

FIG. 3 is a top plan view of a typical connective linkage between a dual steering cable push rod yoke and an outboard motor control arm including a stabilizing apparatus according to a first embodiment of the invention.

FIG. 7 is an end elevation view of a similar stabilizing apparatus to that of FIG. 5 with a sleeve insert installed.

DETAILED DESCRIPTION OF THE INVENTION AND PREFERRED EMBODIMENTS THEREOF

Figure 1:
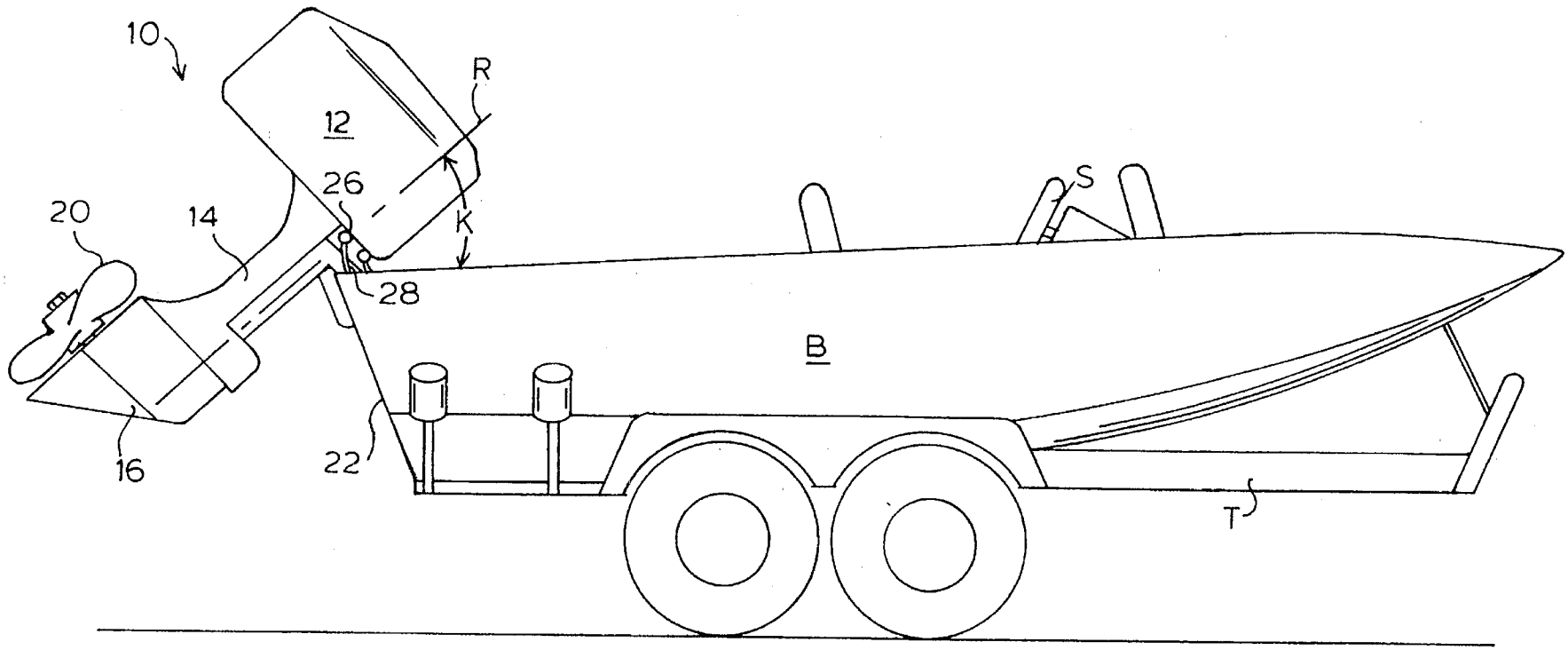
FIG. 1 is a side elevation view of a boat being transported on a trailer and to which an outboard motor is mounted.

A typical recreational boat B with an outboard motor 10 mounted on the transom 22 thereof is illustrated in side elevation in FIG. 1 and rear elevation in FIG. 2. Boat B is secured on trailer T for towing on the road. For purposes of towing and for placing boat B into and removing boat B from water, outboard motor 10 is tilted at an angle K so that propeller 20 is elevated so as not to be damaged. The apparatus referred to as outboard motor 10 comprises gasoline powered internal combustion engine 12, drive shaft tunnel 14, gear housing 16 and propeller 20. Drive shaft tunnel 14 generally covers a drive shaft (not shown) which transmits power from engine 12 to a set of gears (not shown) which is contained within gear housing 16. Whenever outboard motor 10 is restored to its vertical position for use on water, steering of boat B is accomplished by swivelling outboard motor 10 about its centerline R so as to direct thrust from propeller 20 in the desired direction. In the case of all medium and large size outboard motors, a controllable steering mechanism (i.e. steering wheel S, FIG. 1) is located toward the front of the boat and is connected to outboard motor 10 by one or two steering cables 28, each of which terminates in a push rod 26. Since this type of steering mechanism is well known, only those portions of the steering mechanism related to the invention are shown in the drawings.

As discussed briefly above, outboard motors are frequently constructed with a major portion of engine 12 residing rearward of centerline R (when centerline R is vertically oriented), to preserve space within the body of boat B. When outboard motor 10 is tilted forward for transport (as in FIG. 1 ), the bulk of the weight of engine 12 is above centerline R, and motor 10 including engine 12 is free to swivel to either side as indicated by arrow A (see FIG. 2). When a boat B is being towed on a trailer T around a curve in the road at highway speeds, the tendency is for motor 10 including engine 12 to swivel around centerline R toward the outside of the curve. This swivelling action generally occurs rapidly and somewhat violently, placing considerable stress on transom 22. If motor 10 including its engine 12 is not restrained against such motion, damage to transom 22 or outboard motor 10 may occur.

The present invention is directed to providing a simple and effective means to restrain the free swivelling movement of motor 10 including its engine 12, thus preventing damage to either the boat or the motor. A first embodiment of the invention disclosed is illustrated as installed on an outboard motor in FIGS. 3 and 4. The stabilizing apparatus of the invention operates through attachment to and utilization of selected moveable and stationary components of the steering mechanism of the boat.

Figure 4:
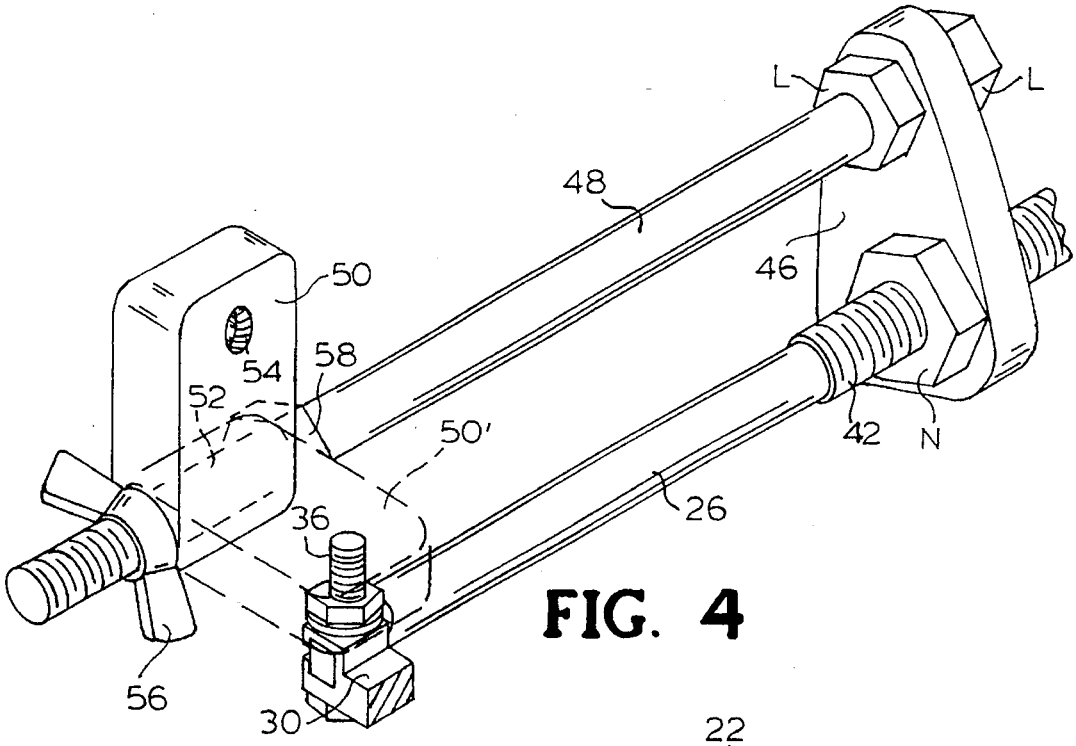
FIG. 4 is a perspective view of the steering linkage and stabilizing apparatus of FIG. 3.

A typical apparatus by which an outboard motor is pivoted for steering the boat is illustrated in FIGS. 3, 4 as generally attached to the boat's transom 22. As illustrated, a two-cable steering mechanism is frequently employed for use with larger outboard motors. Steering cable 28 connects through fixedly positioned sleeve 42 to push rod 26. As a steering wheel S (FIG. 1) or other direction controlling device (not shown) is manipulated, each cable 28 causes each push rod 26 to move right or left with connected yoke 30 and link 32 moving control arm 34, which is rigidly connected to engine 12 (FIGS. 1, 2) and positions propeller 20 as desired. Sleeve 42 is externally threaded to allow adjustment to obtain the "neutral" position of the steering apparatus.

Apparatus of the first embodiment of the invention is shown as being installed for use in conjunction with the type of steering mechanism having a pair of push rods 26. A bracket 46 is mounted to a laterally non-moving component, such as sleeve 42 and fastened in position by a pair of opposed nuts N. Rod 48 is connected to bracket 46, such as by being inserted through a drilled hole and secured with a pair of locking nuts L at one end thereof. Rod 48 extends to the vicinity of yoke 30 at its other end. Yoke 30 is fitted with a special elongated bolt 136 which extends perpendicularly outward from yoke 30 (see FIG. 4). A rigid connection, or block 50, is pivotally fitted by hole 52 onto the distal end of rod 48 and also has a hole 54 whose center can be aligned with the center of elongate bolt 36 in a common plane. Hole 54 is located so as to engage bolt 36 when block 50 is spaced outwardly of an in perpendicular relation to hole 52 and is pivoted as in FIG. 4. A stop, such as nut 58, is assembled on rod 48 to position block 50 as described, and a wing nut 56 is threaded on the distal end of rod 48 to provide locking means for block 50.

When boat B is in the water and steering control is needed, block 50 is held in an unlocked position as illustrated in solid lines in FIG. 4 by clamping pressure of wing nut 56. When it is desirable to lock the position of the outboard motor to prevent swivelling, as when boat B is being transported, block 50 is pivoted about rod 48 so that hole 54 engages bolt 36 as illustrated in dashed lines, locking block 50 in position by tightening wing nut 56. For ease of use, it is preferred to form hole 54 with a flared entry to readily slip over the end of bolt 36. The lateral position of block 50 relative to yoke 30 and bolt 36 may be adjusted by moving nuts N, nuts L, or nut 58.

Figure 5:
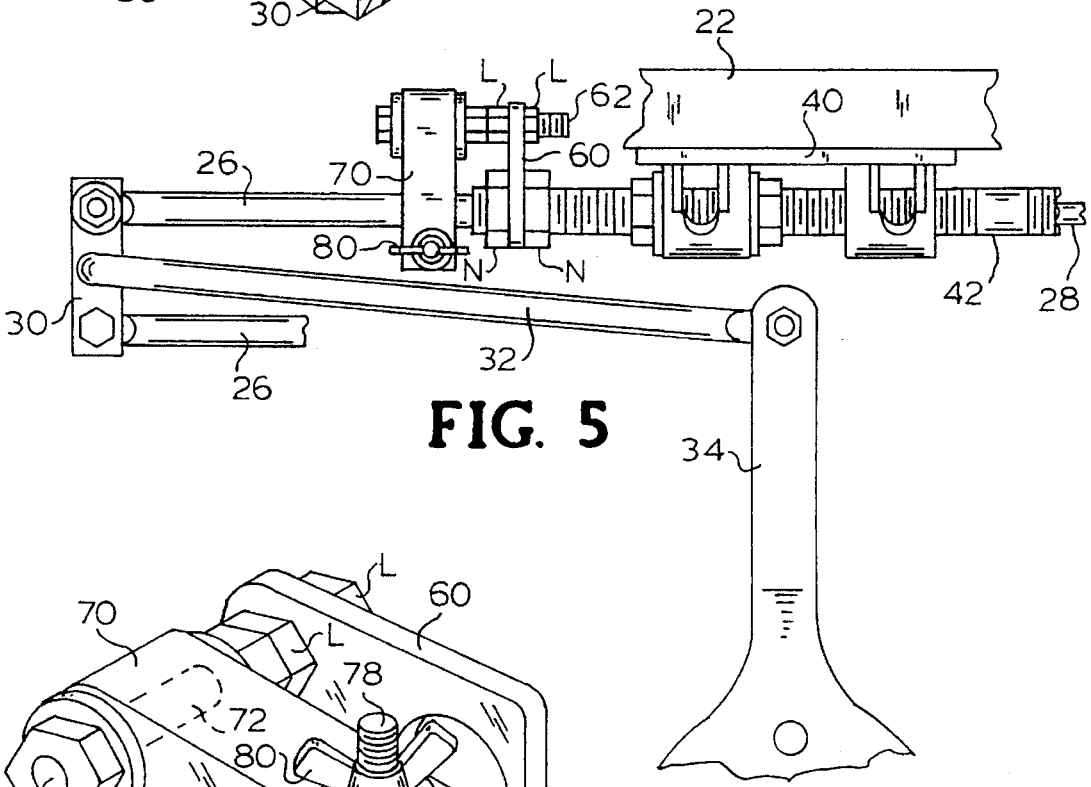
FIG. 5 is a top plan view of a typical connective linkage between a dual steering cable push rod yoke and an outboard motor control arm including a stabilizing apparatus according to a second embodiment of the invention.
Figure 6:
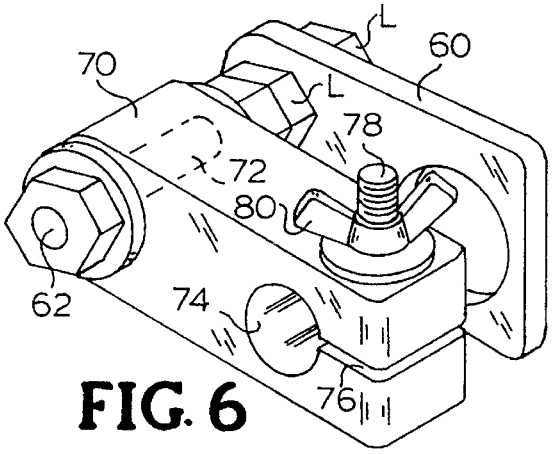
FIG. 6 is a perspective view of the steering linkage and stabilizing apparatus of FIG. 5.

A second preferred embodiment of the invention is illustrated in FIGS. 5, 6 and 7. The view of FIG. 5 includes steering mechanism components as depicted in FIG. 3 and described above. A second type connector, split block 70, formed of a material capable of applying a frictional grip when pressed into intimate contact with another part, is formed with mounting hole 72 and clamping hole 74 in parallel relation to one another. A split 76 is formed outwardly of clamping hole 74 and extends to the outer surface of split block 70. A locking screw 78 with a wing nut 80 are assembled transverse to split 76. Split block 70 is mounted with bracket 60 from threaded sleeve 42 as described above with reference to the first preferred embodiment. Rod 62 and appropriate locking nuts L or other means of securement are employed to position split block 70 so that clamping hole 74 is concentric with cable push rod 26 as shown in FIG. 5.

When boat B is in use in the water and steering freedom is needed, split block 70 is relaxed. When it is desired to restrict the movement of outboard motor 10, such as during boat transporting operations, wing nut 80 is tightened so as to press the free end of split block 70 and clamp push rod 26. A preferred material of which to form split block 70 is either polyurethane resin or hard neoprene synthetic rubber. Alternatively, split block 70 may be formed primarily of metal with an appropriate frictional insert sleeve 75 placed into clamping hole 74, as shown in FIG. 7.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A stabilizer for preventing lateral rotation of an outboard motor while being transported mounted on a boat transom, said motor having a steering mechanism comprising a fixed portion secured to said transom and a moveable portion supported by said fixed portion and connected to said motor, said stabilizer comprising:

(a) a connector extending between a first end pivotably mounted on said fixed portion and a second end adapted when said connector is appropriately pivoted to engage said moveable portion; and (b) locking means mounted on said fixed portion and adapted when said second end engages said moveable portion to releasably secure said second end to said moveable portion and thereby prevent lateral rotation of said motor.

2. The stabilizer as described in claim 1, wherein said connector comprises a block having a hole formed therein and mounted so as to be able to pivot between a disengaged position and an engaged position with said hole configured and located so as to engage said movable portion of said steering mechanism when said block resides in said engaged position.

3. The stabilizer as described in claim 2, further comprising an elongate bolt fixedly mounted on said moveable portion in an orientation to enter said hole when said block is appropriately pivoted.

* * * * *